US006997364B2

(12) United States Patent
Oetlinger

(10) Patent No.: US 6,997,364 B2
(45) Date of Patent: Feb. 14, 2006

(54) LOCATOR BRACKET FOR THE LOWER FRAME ASSEMBLY OF A BLANKING TOOL

(75) Inventor: Frank E. Oetlinger, Grafton, WI (US)

(73) Assignee: Blanking Systems, Inc., Grafton, WI (US)

( * ) Notice: Subject to any disclaimer, the term of this patent is extended or adjusted under 35 U.S.C. 154(b) by 30 days.

(21) Appl. No.: 10/246,808

(22) Filed: Sep. 18, 2002

(65) Prior Publication Data

US 2004/0050226 A1 Mar. 18, 2004

(51) Int. Cl.
*B26F 3/00* (2006.01)

(52) U.S. Cl. ..... 225/104; 83/698.31

(58) Field of Classification Search ..... 225/97, 225/103, 104; 83/698.31; 403/397, 400; 493/372

See application file for complete search history.

(56) References Cited

U.S. PATENT DOCUMENTS

| | | | | |
|---|---|---|---|---|
| 2,523,785 | A * | 9/1950 | Sereno | 403/188 |
| 3,806,994 | A * | 4/1974 | Lankford | 403/397 |
| 4,141,191 | A * | 2/1979 | Aarons | 52/715 |
| 4,358,216 | A * | 11/1982 | Pleickhardt et al. | 403/387 |
| 4,723,749 | A * | 2/1988 | Carraro et al. | 248/317 |
| 4,800,698 | A * | 1/1989 | Murphy | 52/714 |
| 5,784,939 | A * | 7/1998 | Rebeaud | 83/563 |
| 6,341,466 | B1 * | 1/2002 | Kehoe et al. | 52/712 |
| 6,390,721 | B1 * | 5/2002 | Wilson et al. | 403/312 |
| 6,520,900 | B1 * | 2/2003 | Sandford | 493/373 |
| 6,708,858 | B1 * | 3/2004 | Oetlinger | 225/104 |

FOREIGN PATENT DOCUMENTS

| | | |
|---|---|---|
| CA | 2 259 785 A | 7/2000 |
| CH | 692 490 A | 7/2002 |
| DE | 40 24 137 A 1 | 2/1991 |
| EP | 0 683 003 A | 11/1995 |

* cited by examiner

*Primary Examiner*—Kenneth E. Peterson
(74) *Attorney, Agent, or Firm*—Boyle Fredrickson Newholm Stein & Gratz S.C.

(57) ABSTRACT

A bracket for properly locating a lower blanking tool with respect to a pull-out frame during a blanking operation in a carton die cutting machine. The bracket is mounted on the inner side of a side rail for the lower blanking tool and includes a projecting spring member releasably engageable within a groove formed in the top side of a corresponding cross rail of the pull-out frame. The bracket also includes a projecting datum member engageable with the inner side of the pull-out frame's cross rail to aid in positioning the lower blanking tool on the pull-out frame.

9 Claims, 9 Drawing Sheets

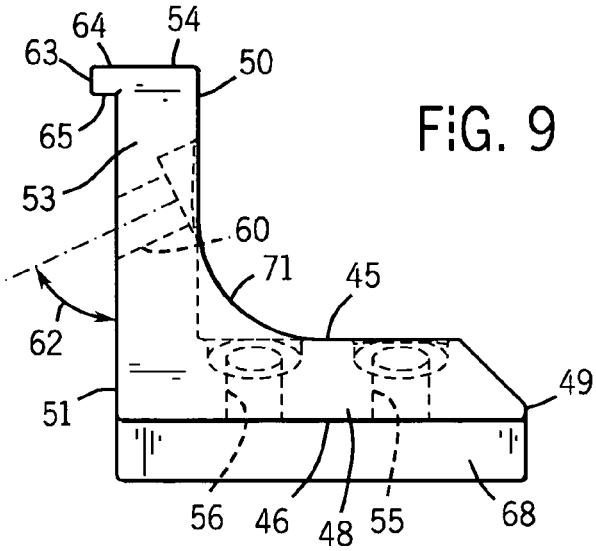
FIG. 9
FIG. 10
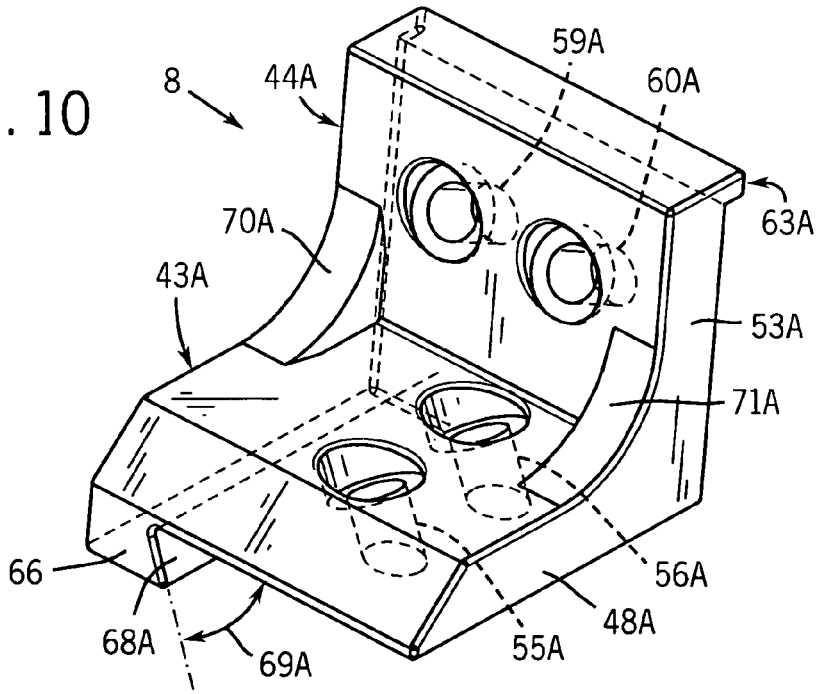

LOCATOR BRACKET FOR THE LOWER FRAME ASSEMBLY OF A BLANKING TOOL

BACKGROUND OF THE INVENTION

The present invention relates to die cutting machines for making carton blanks, and more particularly to a bracket for properly locating a lower blanking tool with respect to a pull-out frame during a blanking operation in a carton die cutting machine.

In the manufacture of cartons, small sheets of paper material having specific profiles are cut out of larger sheets of paper material. These smaller sheets are known as carton blanks which, in turn, are formed into cartons and/or boxes. The blanks are formed during a process known as a blanking operation in a die cutting machine.

In a die cutting machine, the blanks are cut, but not removed from a large sheet of paper material. After the blanks have been cut, the sheet is moved downstream in the die cutting machine to a blanking station where the sheet is positioned over a lower tool or frame assembly for support. The lower tool or frame assembly includes an outer frame and an inner grid having large openings which correspond in size, in shape and in position to the profile of the carton blank previously cut. The lower tool is mounted on a pull-out frame, and below the pull-out frame is a mechanism for stacking the carton blanks.

At the blanking station, an upper tool is used in combination with the lower tool or frame assembly to knock the carton blanks from the sheet of paper material while holding the scrap material that surrounds the blanks. The upper tool has a support board that moves vertically up and down in the die cutting machine, and the support board typically has a plurality of stand-offs depending therefrom that hold pushers spaced beneath the board which in turn are used to push the carton blanks from the sheet through the lower tool or frame assembly. A plurality of presser assemblies are also mounted in the support board and depend therefrom to hold the scrap material against the lower tool or frame assembly during the blanking operation so that the blanks may be pushed from the sheet. A presser assembly typically includes a presser rail which is biased downwardly away from the support board by a spring so that the rail is positioned slightly below the pushers. As the upper tool is lowered, the presser rail engages the sheet of paper material first such that a scrap portion of the large sheet of material is secured between the presser rail and the frame. The upper tool then continues to be lowered such that the sheet of material engages the inner grid within the frame while at substantially the same time the pushers engage the carton blanks and knock the blanks out of the sheet of material and through the inner grid. The carton blanks then fall into a stacking mechanism below the frame where the blanks are stacked for further processing.

The frame and grid of the lower tool support a sheet of paper material during the blanking operation, and thus the grid must be configured to match or conform to the desired die cut in the sheet of paper material. Also, the lower tool must be properly positioned with respect to the pull-out frame so that the grid is properly positioned with respect to both the upper tool and the stacking mechanism. In addition, the grid and outer frame must be disassembled, reconfigured and reassembled whenever a different carton blank needs to be produced. Unfortunately, due to manufacturing tolerances, ineffective clamping devices and the like, outer frames are not always "square" with respect to the pull-out frame. In addition, the grid may not always be positioned with high precision within the outer frame since the clamping pieces which hold the lower tool onto the pull-out frame can move slightly during assembly and thus alter the desired position of the grid.

SUMMARY OF THE INVENTION

It is an object of the present invention to provide an improved frame assembly for a lower blanking tool of a carton die cutting machine.

Yet another object of the invention is to provide a frame assembly for a lower blanking tool which is easy to assemble, compatible with standard blanking operation machinery, and relatively inexpensive.

In order to accomplish the above objects, the present invention provides a frame assembly for a lower blanking tool of a carton die cutting machine. The frame assembly includes an outer frame for supporting a sheet of die cut paper material during a blanking operation wherein the sheet of paper material defines a substantially horizontal plane. The outer frame includes a pair of opposite, spaced apart longitudinally extending side rails, and a pair of opposite, spaced apart cross rails extending crosswise between the side rails. Each of the cross rails have an inner surface disposed substantially transverse to the plane defined by the sheet of paper material and have a T-shaped slot formed therein opening to the inner surface. Each of the side rails have an upper surface disposed substantially parallel to the plane defined by the sheet of paper material and have a T-shaped slot formed therein opening to the upper surface. Each of the T-shaped slots define a downwardly extending axis disposed at an acute angle with respect to the plane defined by the sheet of paper material. The frame assembly also includes a plurality of corner pieces which rigidly interconnect the rails together. Each of the corner pieces includes fasteners extending into the T-shaped slots of adjacent side and cross rails. The downward extending axis of each T-shaped slot together with the design of the corner pieces compensates for any geometric or extrusion tolerances in the side and cross rails so that high precision may be maintained to insure that the frame remains square.

As noted previously, the lower blanking tool must be properly positioned with respect to a pull-out frame so that the grid supported by the frame assembly of the lower blanking tool is properly positioned with respect to both the upper tool and the carton blank stacking mechanism. In order to position the lower blanking tool precisely with respect to the pull-out frame, the present invention provides a locator bracket mounted on a side rail of the lower blanking tool having a spring member projecting therefrom which is releasably engageable within a spring receiving groove formed in a cross rail of the pull-out frame. The locator bracket includes a datum member having an abutment surface which is engageable with an inner surface of the cross rail of the pull-out frame which aids in positioning the lower blanking tool with respect to the pull-out frame. The locator bracket thus releasably interconnects the lower blanking tool on the pull-out frame.

BRIEF DESCRIPTION OF THE DRAWINGS

The drawings illustrate the best mode presently contemplated of carrying out the invention.

In the drawings:

FIG. 9 is an opposite side view of the corner piece of FIG. 6;

FIG. 10 is a perspective view of a left corner piece used to rigidly interconnect a side rail to a cross rail of the frame assembly;

DETAILED DESCRIPTION OF THE PREFERRED EMBODIMENTS

Figure 1:
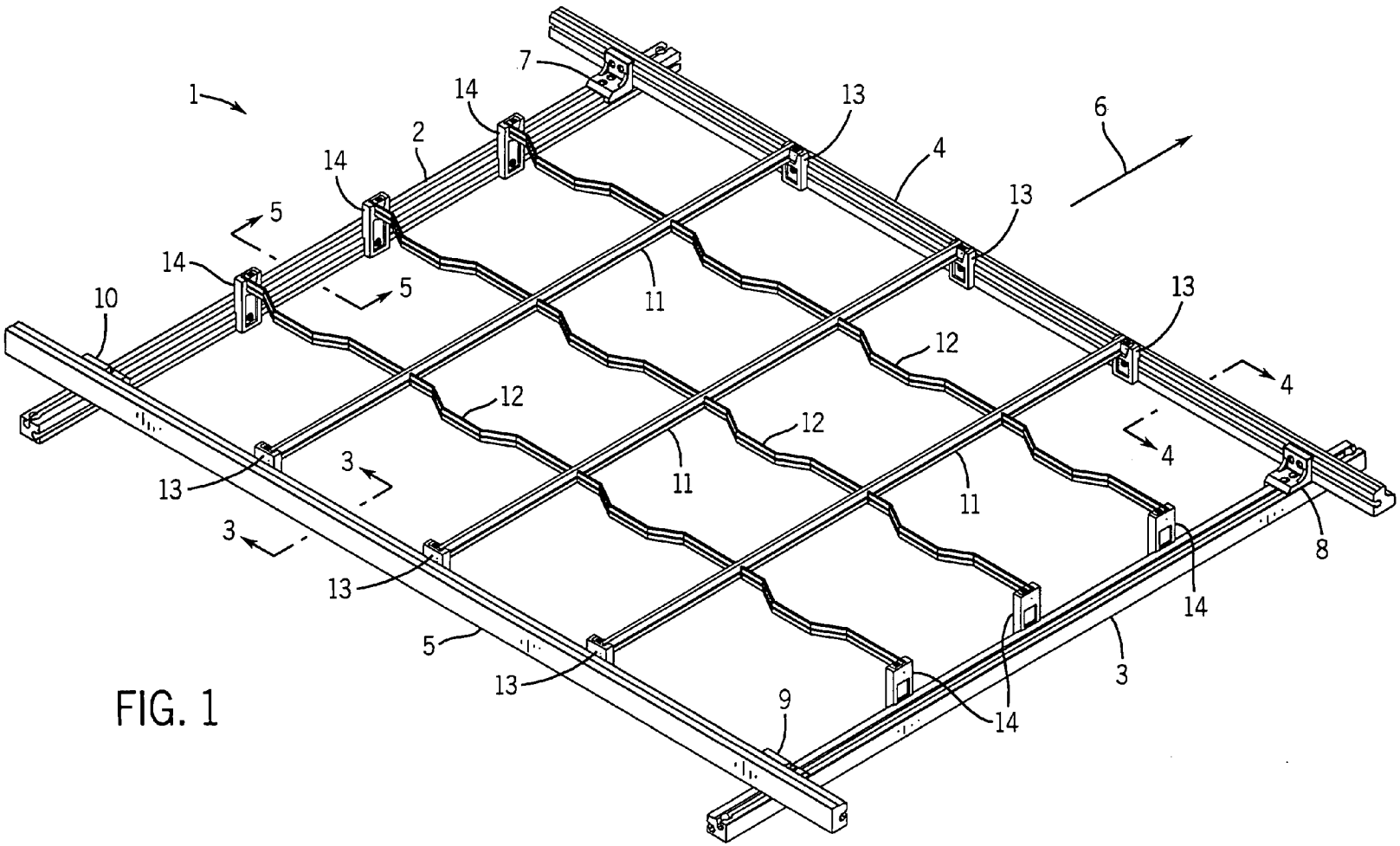
FIG. 1 is a perspective view of a lower frame assembly for a blanking tool of a carton die cutting machine constructed in accordance with the principles of the present invention.

Referring now to the drawings, FIG. 1 illustrates a lower frame assembly generally designated by the numeral 1 which is used in a blanking tool of a die cutting machine for converting or processing a sheet of paper material into a carton blank. These machines are well known in the art and are used to cut one or several blanks into each sheet of paper material which, after folding and gluing, may be formed into cartons or boxes. As is conventional, the sheets of paper material move in a substantially horizontal plane within the machine and are carried through various sequences of printing, cutting, embossing, creasing, waste stripping and/or blanking stations.

The die cutting machine usually is formed by a series of stations with the first station being a starting position or input station in which the sheets, which may be preprinted if desired, are taken one by one from the top of a stack to a feed table where they are placed in position against frontal and side guides. The sheet can then be grasped by a gripper bar and lead downstream or in the machine direction into subsequent processing stations. Typically, the sheet is first conveyed into a cutting station where the carton or box blanks of a desired size and profile are die cut into the sheet. These blanks are held to the sheet by knicks which are arranged along the cut edges of the blanks. This cutting station is usually comprised of upper and lower tools, one of which is provided with a plurality of line-shaped straight and curved die cutting blades. If desired, the cutting station may be proceeded by a printing station, or as noted above, the sheets may be preprinted. After cutting, the sheet is then lead to a stripping station where the waste, i.e. the unused scrap between the various blanks, are grasped by upper and lower pins in order to be lead downward into a waste container. The sheet is then fed to a blanking station where the sheet is positioned horizontally over a lower frame for support. The lower frame includes an inner grid having large openings which correspond in size, in shape and in position to the profile of the blank previously cut. An upper blanking tool having one or more presser assemblies mounted thereto then moves vertically downwardly in the die cutting machine to secure the scrap portions against the grid and frame and then as the tool continues to move downwardly, the fasten points or knicks between the blanks and the sheet are broken by pushers so that each of the blanks are released, pushed through the grid and falls below the frame where the blanks are stacked for further processing. Finally, the residual or remaining portion of the sheet is carried into a delivery or exit station where it is released by the gripper bar as waste material.

Referring now to FIG. 1, there is illustrated frame assembly 1 for a lower blanking tool of a carton die cutting machine. The lower frame assembly 1 includes an outer frame comprised of a pair of opposite, spaced apart longitudinally extending side frame members or side rails 2 and 3, and a pair of opposite, spaced apart cross frame members or cross rails 4 and 5 extending crosswise between side rails 2 and 3. Arrow 6 illustrates the machine direction, i.e. the direction of movement of a sheet of paper material (not shown) within the die cutting machine. Thus, as illustrated in FIG. 1, side rail 2 would be considered the left side rail while side rail 3 would be considered the right side rail. Likewise, cross rail 4 would be considered the front or leading cross rail while cross rail 5 would be considered the rear or trailing cross rail. As illustrated, cross rails 4 and 5 each have a length such that their opposite ends overlap the opposite ends of side rails 2 and 3. Also, cross rails 4 and 5 are disposed on top of side rails 2 and 3 so that the lower surface of cross rails 4 and 5 abut against the upper surfaces of side rails 2 and 3, as will hereinafter be described.

Side rails 2 and 3 are rigidly interconnected to cross rails 4 and 5 by means of a plurality of corner pieces 7–10. Corner pieces 7 and 9 are referred to herein as right corner pieces while corner pieces 8 and 10 are referred to herein as left corner pieces. The terms "right" and "left" refer to the location of a tenon on the underside of each corner piece (see FIG. 6 versus FIG. 10), but it should be noted that left corner pieces 8 and 10 are essentially mirror images of right corner pieces 7 and 9. Corner pieces 7–10 are used to rigidly interconnect rails 2–5 to one another, and function like clamps to tightly hold rails 2–5 together in a "square" or 90° relationship, as will hereinafter be described.

The inner grid is composed of a plurality of parallel lengthwise bars 11 extending in the machine direction between front rail 4 and rear rail 5, and a plurality of substantially parallel crosswise bars 12 extending transversely to the machine direction 6 between left rail 2 and right rail 3. Bars 1 and 12 of the inner grid can be point welded or glued with adhesive at the points where they intersect to insure rigidity of the inner grid. Bars 11 are attached to cross rails 4 and 5 by means of a plurality of attachment pieces 13. Likewise, bars 12 are attached to side rails 2 and 3 by a plurality of attachment pieces 14. It should be noted that the present invention is not limited to the design for the inner grid illustrated in FIG. 1 as the design illustrated is but one example of an inner grid design. In fact, the profile of the inner grid is typically changed depending upon the type, size and shape of the carton blank to be produced. Thus, the inner grid illustrated in FIG. 1 is for illustration purposes only.

Figure 2:
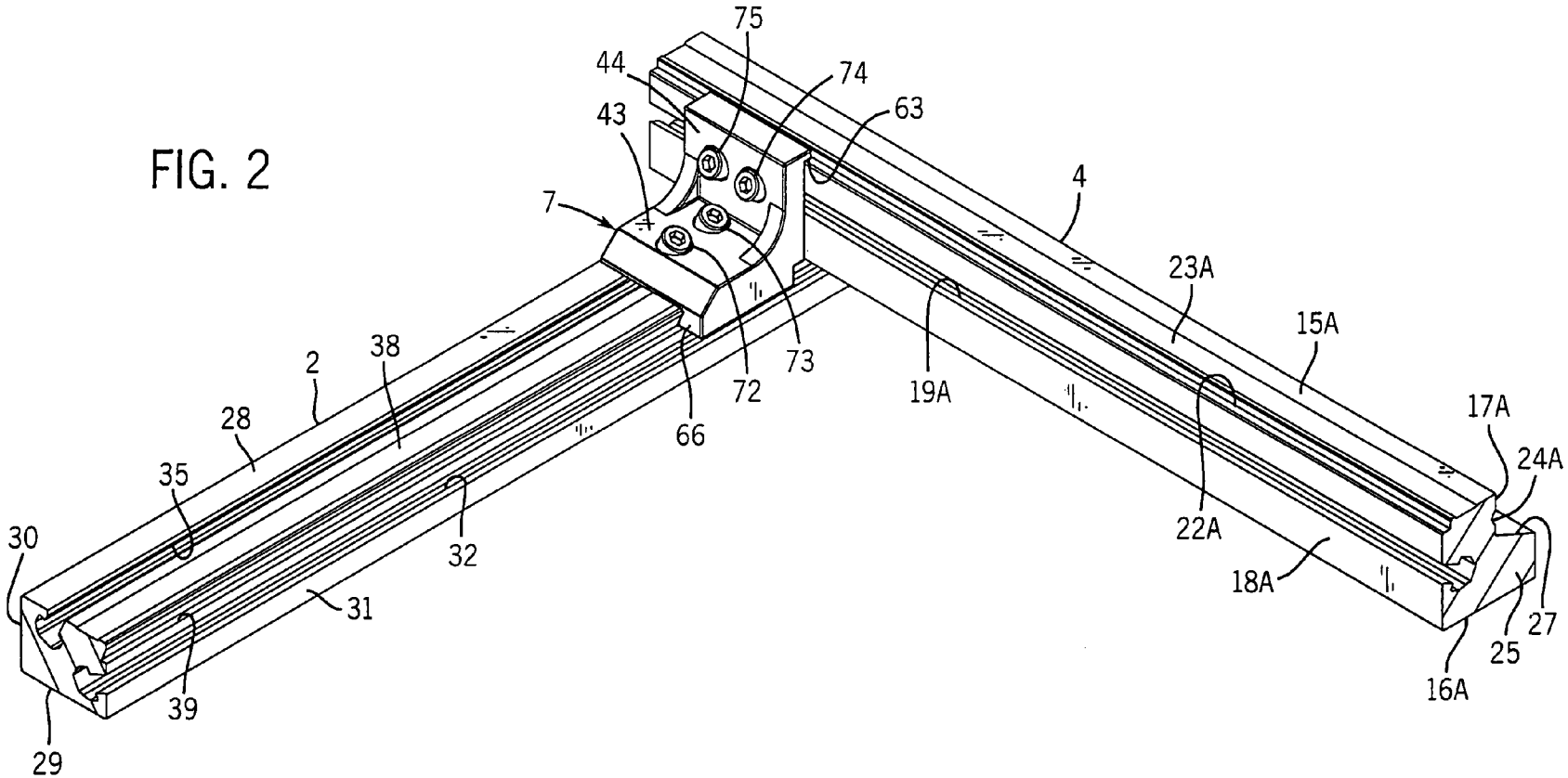
FIG. 2 is an enlarged perspective view, partially in section, illustrating a corner piece rigidly interconnecting a side rail and cross rail of the frame assembly.
Figure 3:
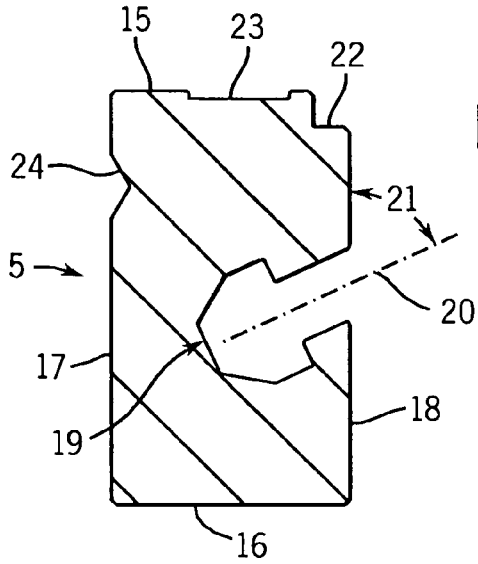
FIG. 3 is a sectional view taken along the plane of the line 3—3 in FIG. 1 of the rear cross rail for the lower frame assembly.

Referring now to FIG. 2, there is illustrated in more detail the interconnection of left side rail 2 to front cross rail 4 by corner piece 7. Before describing the clamping of side rail 2 to cross rail 4, reference is made to FIG. 3 wherein the cross sectional profile of rear cross rail 5 is illustrated. More specifically, cross rail 5 includes an upper surface 15, an opposite lower surface 16, an outer surface 17, and an opposite inner surface 18. Each surface 15–18 is substantially planar, and surface 18 is referred to as the "inner" surface since it faces the interior of frame assembly 1, i.e. towards the inner grid. As shown best in FIG. 3, rail 5 includes a bolt receiving T-shaped slot 19 formed therein. Slot 19 is formed throughout the entire elongate length of rail 5 and as shown best in FIG. 1, opens to both of the opposite ends of rail 5. Slot 19 has a blind end located within the interior of rail 5 and has an open end which opens to inner surface 18. Slot 19 defines a downwardly extending axis 20 disposed at an acute angle 21 with respect to the plane of inner surface 18. As shown in FIG. 3, acute angle 21 is defined as the angle between axis 20 and the plane of inner surface 18. Acute angle 21 may be an angle between 1° and 89°, but is preferably an angle of about 30° to about 80°, and most preferably an angle of about 65°.

As shown in FIG. 3, rail 5 also includes an inwardly projecting ledge 22 formed in inner surface 18. Ledge 22 is planar in shape and is disposed at an angle of 90° with respect to inner surface 18. However, ledge 22 could also be modified to be at an acute angle with respect to inner surface 18 if desired. As shown, ledge 22 is located at the intersection of the upper surface 15 and inner surface 18 of rail 5 such that ledge 22 is located between upper surface 15 and T-shaped slot 19. As shown best in FIG. 1, ledge 22 extends along the entire length of rail 5 and opens to both of the opposite ends of rail 5 in a manner similar to slot 19.

Rail 5 further includes a channel-shaped recess 23 formed in upper surface 15. Again, as shown best in FIG. 1, recess 23 is formed and extends along the entire length of rail 5 and opens to both of the opposite ends of rail 5. Recess 23 is typically utilized to receive a ruler or other measuring device which aids in the proper placement of attachment members 13 and 14 when building the inner grid.

Rail 5 also includes a V-shaped cavity 24 formed in its outer surface 17. Again, as with slot 19, ledge 22 and recess 23, cavity 24 is formed along the entire length of rail 5 and opens to both of the opposite ends of rail 5, as shown best in FIG. 1. Typically, each face of cavity 24 is formed at a 60° angle to a horizontal line running through the center thereof. The function of cavity 24 is to locate a linear scale for measuring placement of the bars 11, 12 for the inner grid.

Figure 4:
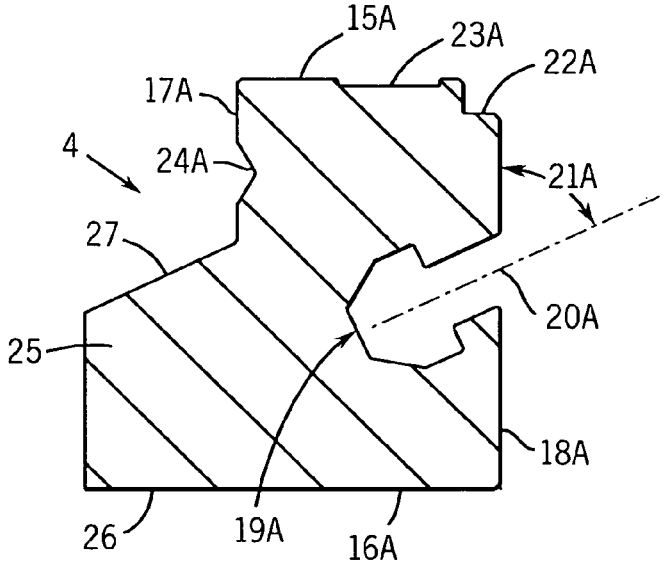
FIG. 4 is a sectional view taken along the plane of the line 4—4 in FIG. 1 of the front cross rail for the lower frame assembly.

Turning now to FIG. 4, there is illustrated the cross sectional profile of front cross rail 4. Front cross rail 4 is identical to cross rail 5 with the exception that rail 4 includes a reinforcement or stiffening member 25. As noted, rail 4 is identical to rail 5 with the exception of reinforcement member 25 so that like numbers, except utilizing the designation "A" therewith, are utilized to refer to like parts or elements. Thus, as illustrated in FIG. 4, reinforcement member 25 projects outwardly from outer surface 17A and is formed along the entire length of rail 4. Although illustrated as being integral with rail 4, reinforcement member 25 could also be a separate piece which could be removably attached with fasteners if desired. Also, although illustrated as having a lower surface 26 contiguous with lower surface 16A of rail 4 and a chamfered surface 27 contiguous with outer surface 17A, reinforcement member 25 could take other shapes and be positioned in a slightly different location than illustrated so long as it functions to stiffen front cross rail 4.

As illustrated, cross rails 4 and 5 are elongated members having opposite ends and a length greater than either its height or its width. Rail 5 and rail 4 (without reinforcement member 25) have a height greater than their width, and are formed of aluminum, preferably extruded aluminum. Extrusion techniques provide the most efficient and cost effect method of producing an aluminum rail having the profile illustrated in FIGS. 3–5.

Figure 5:
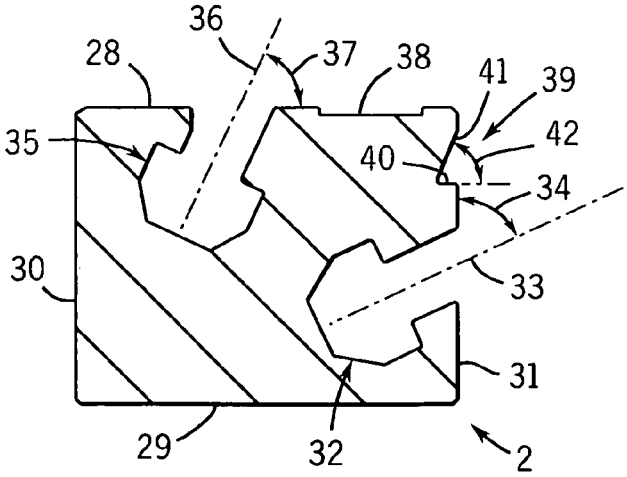
FIG. 5 is a sectional view taken along the plane of the line 5—5 in FIG. 1 of a side rail for the lower frame assembly.

Referring now to FIG. 5, there is illustrated the cross sectional profile of side rails 2 and 3. The profiles of rails 2 and 3 are identical, and therefore only one will be described, i.e. side rail 2. As illustrated, side rail 2 is an elongate member having a length greater than either its height or its width. However, rail 2 has a width which is slightly greater than its height which enables it to accommodate the additional slot to hereinafter be described. Again, as with rails 4 and 5, rails 2 and 3 are composed of aluminum, preferably extruded aluminum. As illustrated, rail 2 has an upper surface 28, an opposite lower surface 29, an outer surface 30 and an opposite inner surface 31. Surfaces 28–31 are substantially planar in shape and are formed along the entire length of rail 2 and extend completely between opposite ends of rail 2. As shown best in FIG. 5, rail 2 includes a bolt receiving T-shaped slot 32 formed therein throughout the entire length thereof. Slot 32 defines a downwardly extending axis 33 disposed at an acute angle 34 with respect to the plane defined by inner surface 31. Acute angle 34 may be any angle between 1° and 89°, but is preferably between about 30° to about 80° and is most preferably about 65°. Slot 32 has a blind end located within rail 2 and has an open end which opens to inner surface 31. As shown best in FIG. 1, slot 32 is formed along the entire length of rail 2 and is open to both of the opposite ends of rail 2.

As shown in FIG. 5, rail 2 further includes a second bolt receiving T-shaped slot 35 formed therein. Slot 35 is identical to slot 32 in shape and also defines a downwardly extending axis 36 disposed at an acute angle 37 with respect to upper surface 28. As with angle 34, acute angle 37 may be any angle between about 1° to about 89°, but is preferably between about 30° to about 80° and most preferably about 65°. Slot 35 is formed along the entire length of rail 2 and opens to both of the opposite ends of rail 2. As illustrated, slot 35 has a blind end located within rail 2 and an open end which opens to upper surface 28. The blind end of slot 35 (as well as the blind end of slots 19, 19A and 32) is configured to conform to the shape of a nut (not shown) captured therein. The nut is utilized to threadedly receive and hold the shank of a bolt extending into slot 35 (as well as slots 19, 19A and 32), as will hereinafter be described.

As illustrated, rail 2 also includes a channel-shaped recess 38 formed in upper surface 28. Recess 38 is formed in upper surface 28 between slot 35 and inner surface 31, and functions to receive a ruler or other measuring device to aid in building the inner grid in a manner similar to recess 23 and 23A in rails 4 and 5. Recess 38 is formed throughout the entire length of rail 2 and opens to both of the opposite ends thereof.

As shown best in FIG. 5, rail 2 also includes an angled groove 39 formed in inner surface 31 above slot 32. Again, groove 39 is formed through the entire length of rail 2 and opens to both of the opposite ends thereof. As illustrated, groove 39 includes an inwardly projecting ledge 40, and an angled surface 41. Ledge 40 has a planar surface and is disposed at an angle of about 90° with respect to inner surface 31. Other acute angles for ledge 40 may be used, but 90° is preferred. As shown in FIG. 4, angled surface 41 forms an acute angle 42 with ledge 40. Angle 42 is generally between about 30° to about 80°, but is preferably about 70°. Groove 39 functions to receive a tenon of corner piece 7 as will hereinafter be described.

Referring now to FIGS. 6–9, right corner piece 7 is illustrated in more detail. As noted earlier, corner piece 7 is identical to corner piece 9 (FIGS. 6–9) while corner pieces 8 and 10 are mirror images thereof (see FIGS. 10 and 11). More specifically, corner piece 7 interconnects side rail 2 and front cross rail 4 of the lower blanking tool frame assembly, and includes an L-shaped body having a horizontal plate member 43 and an upright or vertical plate member 44. Horizontal plate member 43 defines a substantially flat upper face 45, a substantially flat opposite lower face 46, an inside face 47, an opposite outside face 48 and an end face 49. As illustrated, each of faces 45–49 are substantially planar in shape. Upright or vertical plate member 44 also defines a substantially flat inner face 50 contiguous with upper face 45, a substantially flat outer face 51 contiguous with lower face 46, an inside face 52 contiguous with the inside face 47 of horizontal plate member 43, an opposite outside face 53 contiguous with the outside face 48 of horizontal plate member 43, and a top face 54. As illustrated, each face 50–54 is substantially planar in shape. As illustrated best in FIGS. 6 and 7, horizontal plate member 43 has a pair of adjacent, aligned outwardly extending bolt receiving bores 55 and 56 formed therethrough extending between upper face 45 and lower face 46. Each bore 55, 56 is identical and defines an axis 57 disposed at an acute angle 58 with respect to the upper face 45 and lower face 46. Acute angle 58 may be between about 1° and 89°, but preferably between about 30° and about 80°, and most preferably about 65°.

Figure 6:
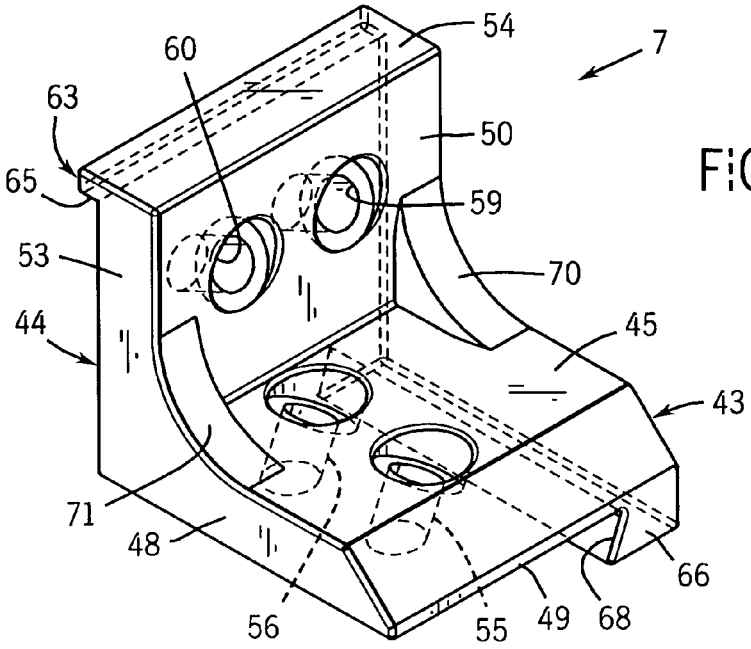
FIG. 6 is a perspective view of a right corner piece used to rigidly interconnect a side rail to a cross rail of the frame assembly.
Figure 8:
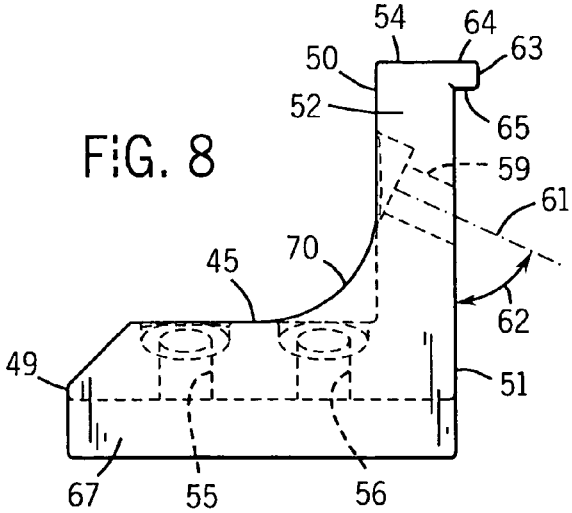
FIG. 8 is a side view of the corner piece of FIG. 6.

As illustrated best in FIGS. 6 and 8, the upright or vertical plate member 44 also includes a pair of adjacent, aligned outwardly extending bolt receiving bores 59 and 60 formed therethrough from inner face 50 to outer face 51. Each bore 59, 60 defines an axis 61 disposed at an acute angle 62 with respect to inner face 50 and outer face 51. Again, acute angle 62 may be anywhere between 1° and 89°, but is preferably between about 30° and about 80°, and is most preferably about 65°.

As seen best in FIGS. 6, 8 and 9, upright plate member 44 has a lip 63 projecting outwardly from outer face 51. Lip 63 has an upper surface 64 and a lower surface 65. Upper surface 64 is contiguous with the top face 54 while lower surface 65 is contiguous with outer face 51. Lower surface 65 is disposed substantially 90° with respect to outer face 51, and lip 63 extends completely across the outer face 51 of plate member 44 from the inside face 52 to the outside face 53. Although illustrated as being contiguous with top face 54, upper surface 64 and lip 63 could also be spaced slightly downwardly therefrom if desired. Also, lip 63 need not necessarily extend completely across outer face 51, but preferably does so to provide the maximum amount of clamp force against ledge 22, as will hereinafter be described.

Figure 7:
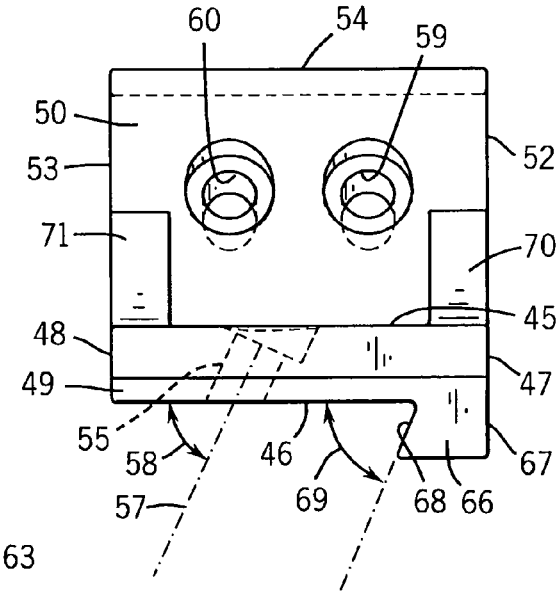
FIG. 7 is a front view of the corner piece of FIG. 6.

As best shown in FIGS. 6 and 7, corner piece 7 also includes a tenon 66 projecting downwardly from the lower face 46 of horizontal plate member 43. Tenon 66 has an inside surface 67 which is contiguous with the inside face 47 of horizontal plate member 43, and an outside surface 68 which is contiguous with lower face 46 of horizontal plate member 43. As shown best in FIG. 7, outside surface 68 is disposed at an acute angle 69 with respect to lower face 46. Acute angle 69 may be any angle between 1° and 89°, but preferably matches the angle 42 formed by surface 41 of groove 39 in side rail 2. Again, by matching angle 69 with angle 42, the maximum amount of friction is provided between surfaces 67 and 41 to provide the maximum clamping force, as will hereinafter be described. Tenon 66 extends completely along the lower face 46 of horizontal plate member 43 from end face 49 to the outer face 51 of upright plate member 44, as shown best in FIGS. 6, 8 and 9. Finally, corner piece 7 includes a pair of reinforcement members or blocks 70 and 71 located at the intersection of inside face 52 of upright plate member 44 and upper face 45 of horizontal plate member 43. As shown best in FIG. 5, each block 70, 71 extends between the upper face 45 and the inner face 50, and preferably comprises a wedge-shaped or triangular-shaped member. Although blocks 70, 71 could be located anywhere along the intersection of upper face 45 with inner face 50, block 70 is preferably located adjacent inside faces 47 and 52 while block 71 is preferably located adjacent outside faces 48 and 53 to provide maximum support or reinforcement for corner piece 7.

FIG. 10 illustrates left corner pieces 8 and 10. As left corner pieces 8 and 10 are mirror images of right corner pieces 7 and 9, they need not be described herein in detail, but identical parts utilize like numerals with the designation "A" therewith. Corner pieces 8 and 10 are referred to as "left" corner pieces since tenon 66A is located on the left side thereof. In like manner, corner pieces 7 and 9 are referred to as "right" corner pieces since tenon 66 is located along the right side thereof. In all other respects, corner pieces 8 and 10 are identical to corner pieces 7 and 9.

In order to assemble frame assembly 1, cross rails 4 and 5 are placed on top of side rails 2 and 3 so that the ends of rails 2–5 overlap one another, as illustrated in FIG. 1. Thereafter, right corner piece 7 is placed as illustrated in FIG. 2 with lip 63 engaging ledge 22A in cross rail 5, and outside surface 68 of tenon 66 engaging angled surface 41 of groove 39 formed in side rail 2. Fasteners 72 and 73 are then inserted through bores 55 and 56 into corresponding nuts contained in slot 35 of side rail 2. As fasteners 72 and 73 are tightened, they engage the nuts to pull or clamp cross rail 4 tightly against side rail 2. At the same time, fasteners 74 and 75 extend through bores 59 and 60 of upright plate member 44 into nuts captured within slot 19A of cross rail 5. As fasteners 74 and 75 are tightened, they pull or clamp the upper surface 29 of side rail 2 tightly against the lower surface 16A of cross rail 5. In this manner, rails 2 and 5 are rigidly interconnected. Thereafter, in a like manner, corner pieces 8–10 are utilized to rigidly interconnect the other three corners of frame assembly 1. As a result, rails 2–5 are rigidly interconnected to one another to form frame assembly 1.

As illustrated best in FIG. 1, the second T-shaped slot 32 formed in inner surface 41 of side rails 2 and 3, is utilized to connect a plurality of attachment pieces 14 for crosswise bars 12 of the inner grid. In like manner, the T-shaped slots 19 and 19A formed in cross rails 4 and 5, are also utilized to connect attachment pieces 13 for mounting lengthwise bars 11 of the inner grid.

Figure 11:
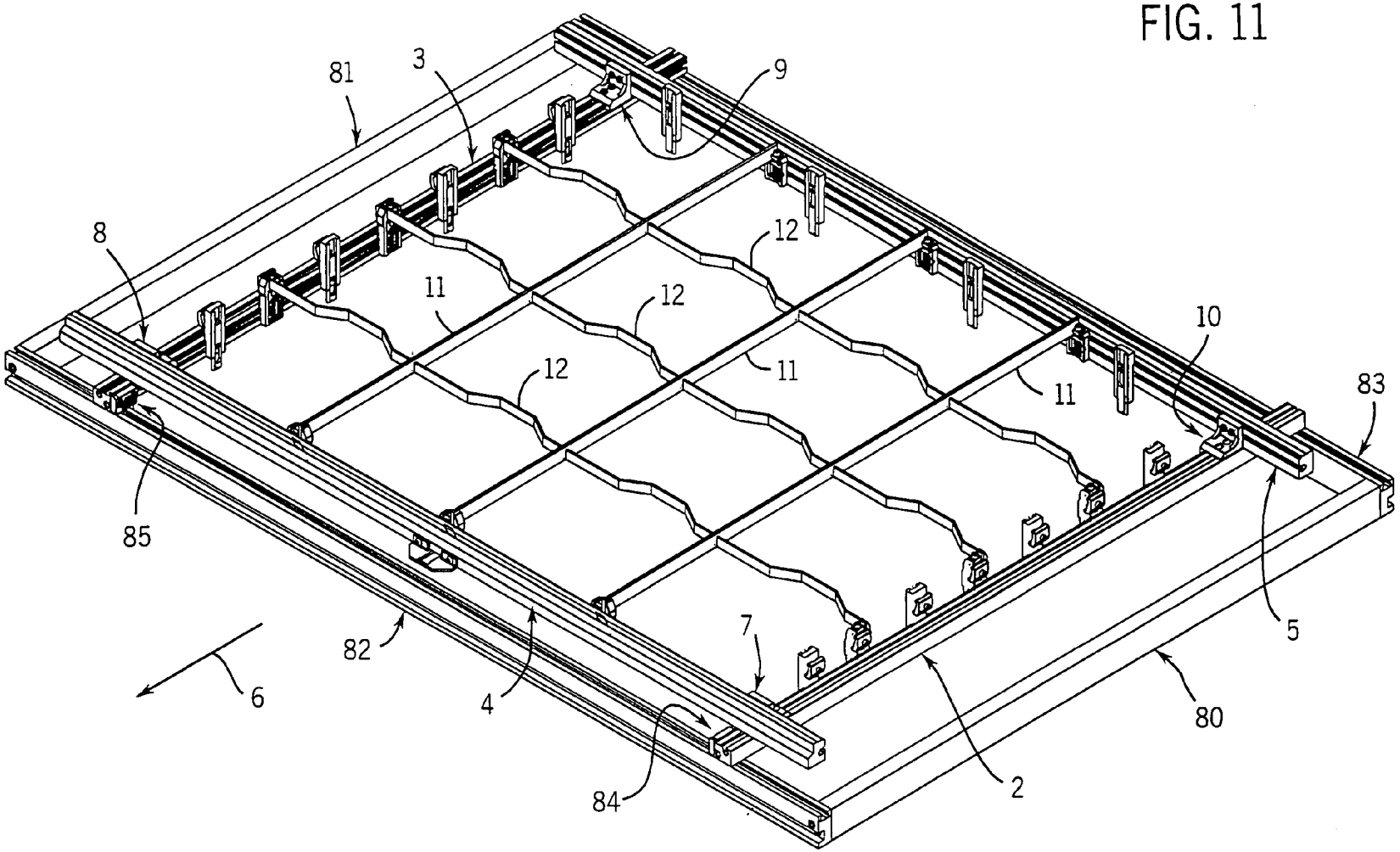
FIG. 11 is a perspective view of a lower blanking tool mounted on a pull-out frame for a carton die cutting machine.

Referring now to FIG. 11, the lower blanking tool is illustrated as being mounted on a pull-out frame. The pull-out frame comprises a pair of opposite, spaced apart longitudinally extending side rails 80 and 81 which extend parallel to side rails 2 and 3, respectively, of the lower blanking tool, and a pair of opposite, spaced apart cross rails 82 and 83 extending crosswise between side rails 80 and 81.

Cross rails 82 and 83 extend parallel to cross rails 4 and 5, respectively of the lower blanking tool. Thus, cross rail 82 would be considered the front or leading cross rail while cross rail 83 would be considered the rear or trailing cross rail. As illustrated, cross rails 82 and 83 have a length greater than the width between side rails 2 and 3 of the lower blanking tool so that their opposite ends extend beyond the leading ends of side rails 2 and 3. Also, cross rails 82 and 83 are disposed beneath side rails 2 and 3 of the blanking tool so that the lower surface of side rails 2 and 3 abut against the upper surface of cross rails 82 and 83, as illustrated. As is conventional, side rails 80 and 81 are bolted to cross rails 82 and 83 to form a permanent fixture on which the lower blanking tool is mounted.

Figure 12:
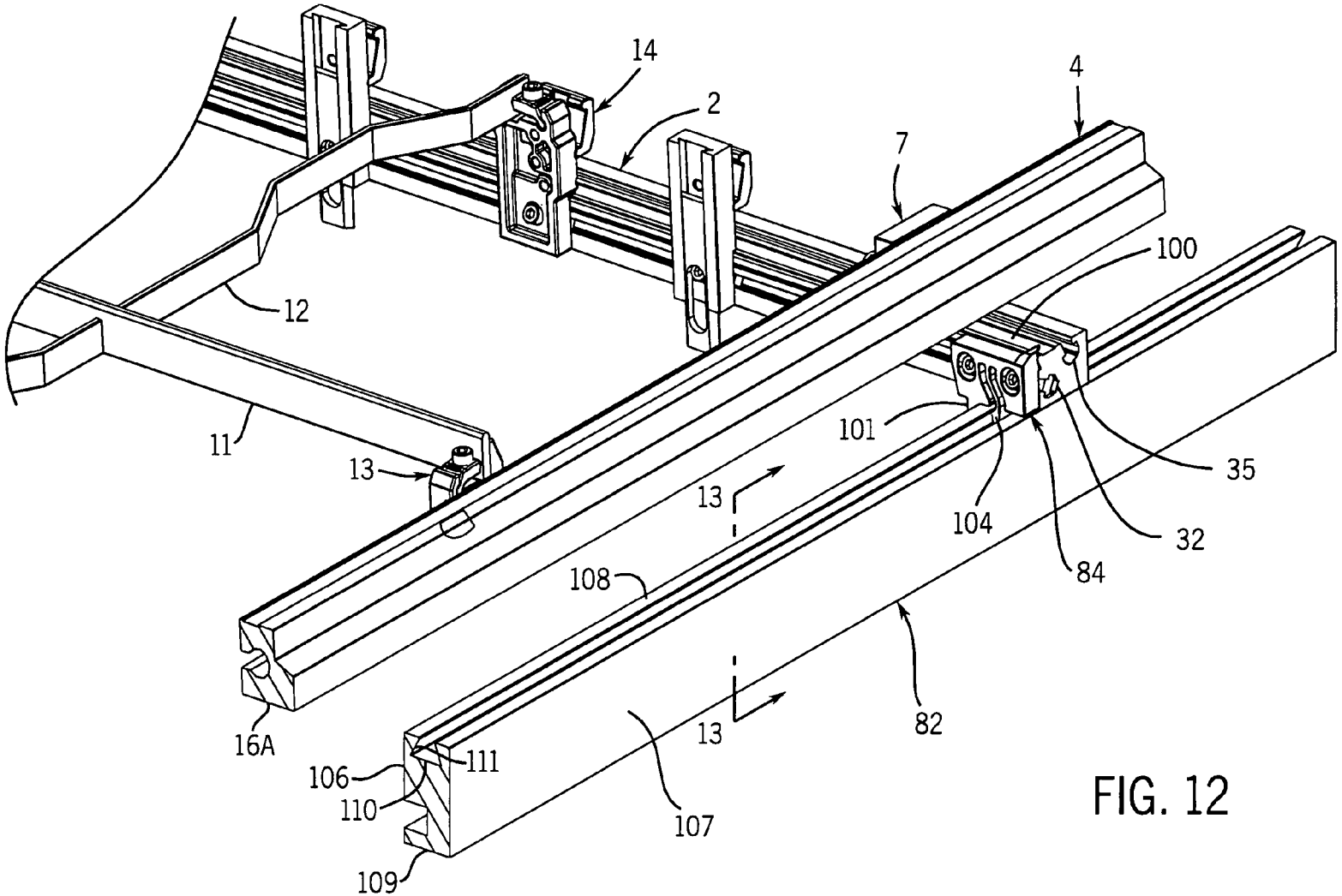
FIG. 12 is an enlarged perspective view, partially in section, illustrating a locator bracket releasably interconnecting a side rail of the lower blanking tool to a cross rail of the pull-out frame.
Figure 13:
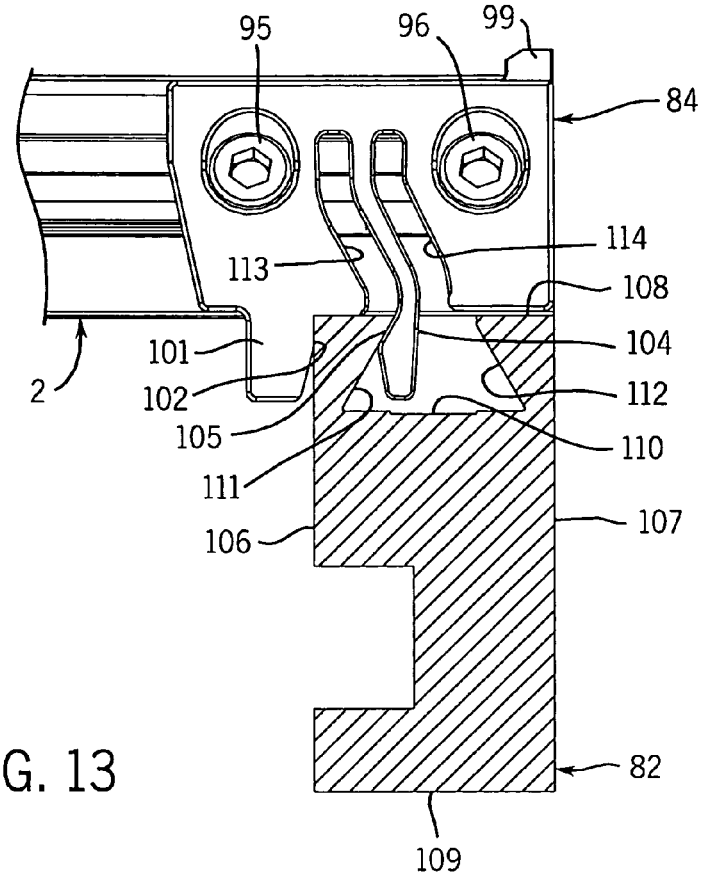
FIG. 13 is a partial cross sectional view taken along the plane of the line 13—13 in FIG. 12.

Referring now to FIGS. 12 and 13, there is illustrated in more detail the releasable interconnection of the lower blanking tool on the pull-out frame. This releasable interconnection properly positions the lower blanking tool on the pull-out frame, and is accomplished by a pair of locator brackets 84 and 85 which are mounted on the forward ends of side rails 2 and 3, respectively and releasably engage cross rail 82 of the pull-out frame. It should be noted that locator bracket 85 is essentially a mirror image of locator bracket 84, and therefore only bracket 84 will hereinafter be described.

Figure 14:
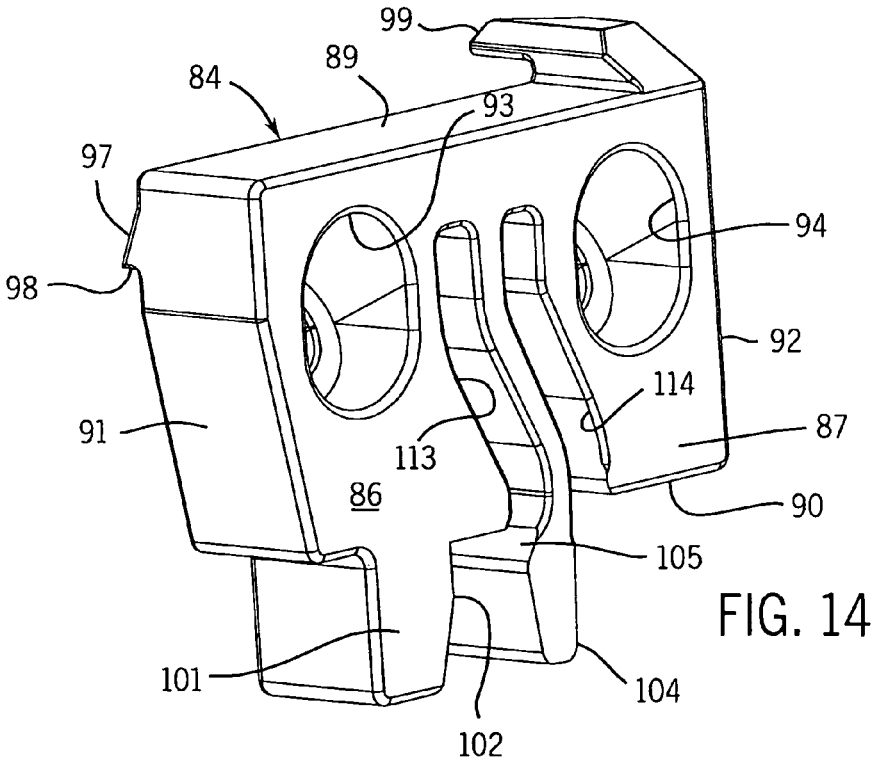
FIG. 14 is a front perspective view of the locator bracket.
Figure 15:
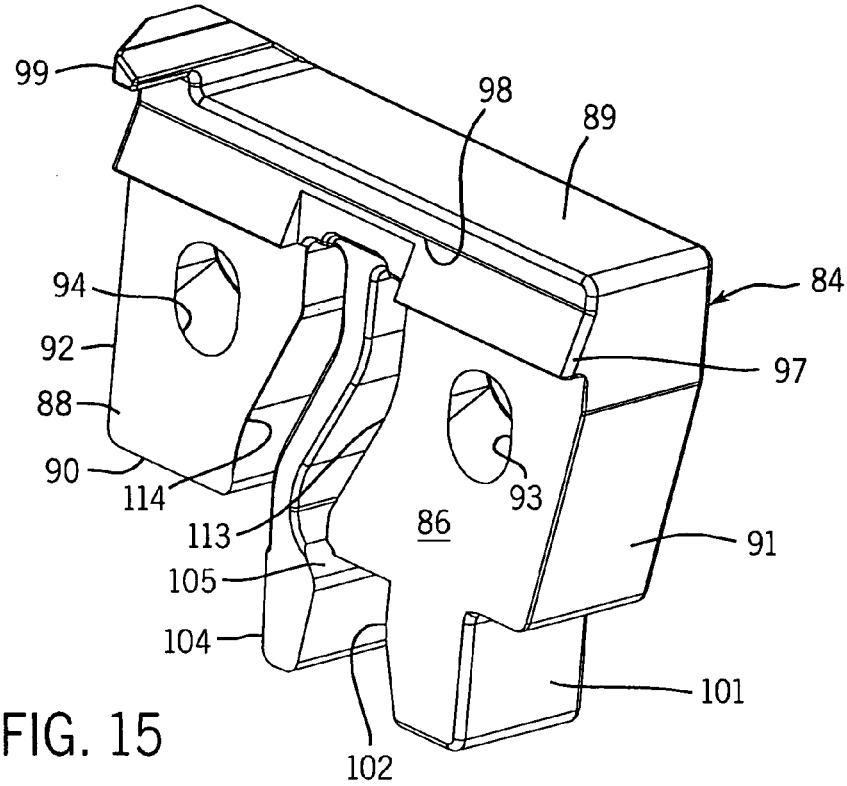
FIG. 15 is a rear perspective view of the locator bracket.
Figure 16:
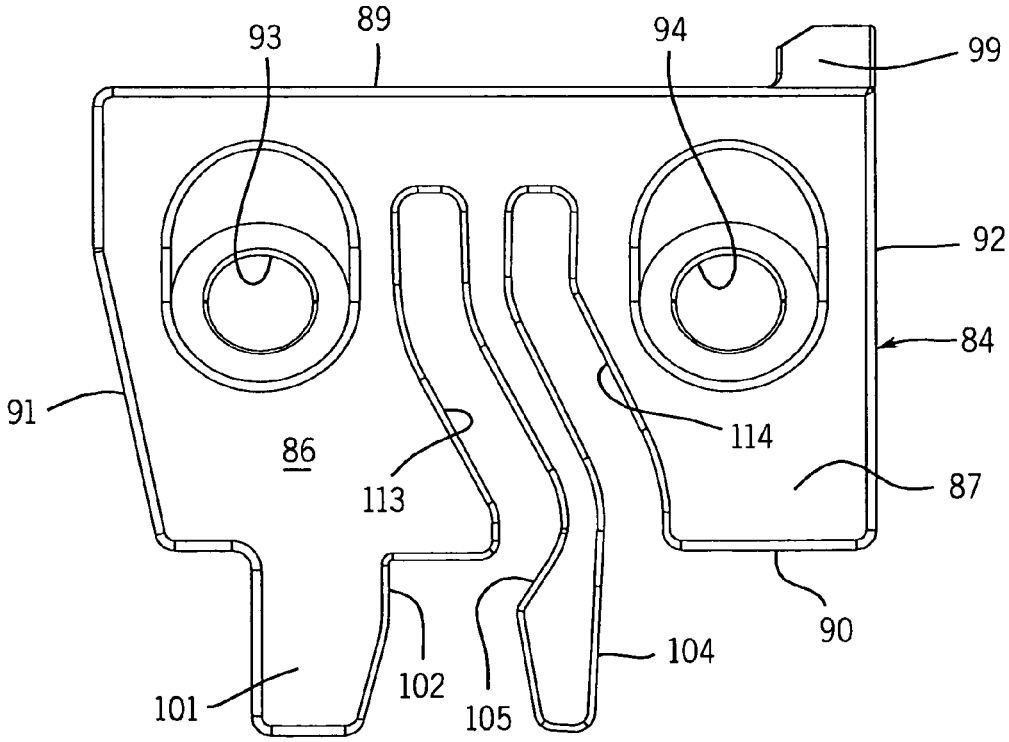
FIG. 16 is a front elevational view of the locator bracket.

Referring now to FIGS. 14–16, bracket 84 includes a plate-like rectangular-shaped body 86 having a substantially flat front face 87, a substantially flat rear face 88, a top face 89, a bottom face 90, and a pair of opposite end faces 91 and 92. As illustrated, each face 87–92 is substantially planar in shape. Body 86 has a pair of adjacent, aligned, spaced apart bolt receiving bores 93 and 94 formed therethrough extending between front face 87 and rear face 88. Each bore 93, 94 is identical and defines an axis disposed at an acute angle with respect to front face 87 and rear face 88. This acute angle may be between about 1° and 89°, and preferably between about 30° and 80°, and most preferably about 65°. This acute angle preferably matches the acute angle formed by the T-shaped slot 32 formed in the inner face or surface 31 of side rail 2 of the lower blanking tool. The fasteners 95 and 96 extend through bores 93 and 94 respectively into corresponding nuts (not shown) contained in slot 32 of side rail 2. As fasteners 95 and 96 are tightened, they engage the nuts to pull or clamp locator bracket 84 tightly against the inner surface 31 of side rail 2. In this manner, bracket 84 is tightly mounted or fastened to rail 2.

In order to properly position locator bracket 84 with respect to side rail 2 so that bores 93 and 94 align with T-shaped slot 32, a rearwardly extending lip 97 projects from rear face 88 of body 86. Lip 97 includes a planar undersurface 98 which engages groove 39 formed in rail 2. Thus, rear face 88 may be positioned flush against the inner surface 31 of rail 2 with the axes of bores 93, 94 aligned with the axis of the T-shaped slot 32 in rail 2.

To aid in properly positioning bracket 84 on side rail 2, bracket 84 includes a pointer or boss 99 extending upwardly and rearwardly from top face 89. Boss 99 is used in combination with indicia 100 on the upper surface 28 of side rail 2 to properly located bracket 84 on side rail 2.

As a further aid in properly positioning the lower blanking tool with respect to the pull-out frame, bracket 84 includes a datum member 101 extending from bottom face 90 and projecting downwardly from body 86. As shown best in FIGS. 14–16, datum 101 includes an abutment surface 102 which is substantially planar in shape and disposed at a 90° angle with respect to bottom face 90. As shown best in FIG. 13, abutment surface 102 engages the top edge of inner surface 106 of cross rail 82 to properly position the lower blanking tool with respect to the pull-out frame.

Locator bracket 84 also includes a spring member 104 for releasably engaging cross rail 82 to interconnect the lower blanking tool on the pull-out frame. Spring member 104 projects downwardly from body 86 and includes a free end having a planar-shaped angled surface 105 disposed beneath bottom face 90. As shown best in FIG. 16, angled surface 105 is disposed at an acute angle with respect to bottom face 90 and is further disposed directly opposite abutment surface 102 so that the distance between abutment surface 102 and angled surface 105 varies as spring member 104 is moved left or right in FIG. 16. It should be noted that spring member 104 is S-shaped in cross section which aids in developing and retaining the appropriate spring force necessary for interconnecting the lower blanking tool on the pull-out frame. Corresponding S-shaped slots 113 and 114 extend through body 86 from front face 87 to rear face 88 and are formed on opposite sides of the shank portion of spring member 104 to permit movement or flexing of spring member 104.

Referring now to FIG. 13, there is illustrated in greater detail the interconnection of locator bracket 84, and thus the lower blanking tool, on the cross rail 82 of the pull-out frame. As illustrated, cross rail 82 includes an inner surface 106 and an opposite outer surface 107 together with a top surface 108 and an opposite bottom surface 109. A dove tail-shaped spring receiving groove 110 is formed along the entire length of rail 82 and opens to top surface 108. Groove 110 thus includes a pair of opposite beveled surfaces 111, 112 formed in the interior of cross rail 82. As seen best in FIG. 13, beveled surfaces 111, 112 are disposed at an acute angle with respect to top surface 103. Preferably, the acute angle of beveled surfaces 111, 112 matches and is identical to the acute angle formed by surface 105 of spring member 104. Thus, when the free end of spring member 104 is inserted into groove 110, angled surface 105 engages beveled surface 111 to releasably engage and interconnect the lower blanking tool on the pull-out frame.

In order to assemble the lower blanking tool on the pull-out frame, locator brackets 84 and 85 are first properly positioned on the ends of side rails 2 and 3 via matching boss 99 with the desired indicia 100. Fasteners 95 and 96 are then tightened so that locator brackets 84 and 85 are affixed to side rails 2 and 3. Thereafter, the lower blanking tool is positioned so that the abutment surface 102 of each datum member 101 is engaged against the inner surface 106 of cross rail 82. Once surfaces 102 and 106 bear against one another, the lower blanking tool is forced downwardly so that the spring member 104 of each bracket 84, 85 is forced within groove 110 so that angled surface 105 engages beveled surface 111 and holds or clamps the lower blanking tool on the pull-out frame. To disengage the lower blanking tool from the pull-out frame, one merely applies sufficient force to pull the lower blanking tool upwardly and disengage spring member 104 from groove 110.

I claim:

1. A lower frame assembly for a carton die cutting machine, comprising:

a lower blanking tool having an outer frame and an inner grid for supporting a sheet of die paper material during a blanking operation;

a pull-out frame disposed beneath said lower blanking tool; and a locator bracket mounting on one of said lower blanking tool or pull-out frame for positioning said lower blanking tool at a desired location with respect to said pull-out frame, said bracket including a spring member releasably engageable with the other of said lower blanking tool or pull-out frame for interconnecting said lower blanking tool and pull-out frame;

wherein:

the outer frame of said lower blanking tool includes a longitudinally extending side rail;

said pull-out frame includes a cross rail extending crosswise with respect to said side rail;

said locator bracket is mounted on said side rail with said spring member projecting therefrom generally in a first direction;

the cross rail includes a spring-receiving groove formed therein for receiving said spring member and a top surface extending substantially parallel to said sheet of die paper material having the spring-receiving groove formed therein, the spring-receiving groove including a beveled surface;

said spring member including an angled surface engagement with the beveled surface; and said locator bracket further includes a datum member projecting therefrom in a second direction, generally parallel to the first direction, the datum member engageable with one of said side rail or cross rail for positioning said lower blanking tool in said pull-out frame and for aligning the spring member with the spring receiving groove.

2. The lower frame assembly of claim 1 wherein the outer frame of said lower blanking tool includes a pair of opposite, spaced apart longitudinally extending side rails and a pair of opposite, spaced apart cross rails extending crosswise between said side rails, and said bracket interconnects at least one of said side rails and said pull-out frame.

3. The lower frame assembly of claim 1 wherein said pull-out frame includes a pair of opposite, spaced apart longitudinally extending side rails and a pair of opposite, spaced apart cross rails extending crosswise between said side rails, and said bracket interconnects at least one of the cross rails of said pull-out frame and said lower blanking tool.

4. The lower frame assembly of claim 1 wherein said side rail includes an inner surface disposed substantially transverse to said sheet of paper material, and said locator bracket is mounted on said inner surface.

5. The lower frame assembly of claim 1 wherein said cross rail includes an inner surface disposed substantially transverse to said sheet of paper material, and said datum member includes a corresponding abutment surface for engagement therewith.

6. A lower frame assembly for a carton die cutting machine, comprising:

a lower blanking tool having an outer frame and an inner grid for supporting a sheet of die cut paper material during a blanking operation;

a pull-out frame disposed beneath said lower blanking tool; and a locator bracket mounting on one of said lower blanking tool or pull-out frame for positioning said lower blanking tool at a desired location with respect to said pull-out frame, said bracket including;

at least one bolt receiving bore configured to receive a fastening device for securing said locator bracket to said blanking tool frame, said bolt receiving bore defining an axis at an acute angle matching an acute angle defined by a t-shaped slot within an inner surface of a side rail of the lower blanking tool; and a spring member releasably engageable with the other of said lower blanking tool or pull-out frame for interconnecting said lower blanking tool and pull-out frame.

7. The lower frame assembly of claim 6, wherein the locator bracket further comprises a lip having a planar undersurface projecting from a rear face of the bracket, said lip configured to engage a groove formed in the side rail.

8. The lower frame assembly of claim 6, wherein the locator bracket further comprises a positioning boss extending upwardly and rearwardly from a top face of the locator bracket.

9. The lower frame assembly of claim 6, wherein the locator bracket further comprises a datum member projecting therefrom and engageable with a side rail or a cross rail of the lower blanking tool frame to aid in positioning said lower blanking tool in said pull-out frame.

* * * * *